United States Patent [19]

Hansel

[11] 4,023,601

[45] May 17, 1977

[54] INTERLOCK SYSTEM FOR A GASOLINE DISPENSING NOZZLE WITH A VAPOR RECEIVING SYSTEM

[75] Inventor: William B. Hansel, Media, Pa.

[73] Assignee: Sun Oil Company of Pennsylvania, Philadelphia, Pa.

[22] Filed: Sept. 2, 1975

[21] Appl. No.: 609,762

[52] U.S. Cl. ..... 141/207; 141/208

[51] Int. Cl.[2] ..... B65B 57/14

[58] Field of Search ..... 41/1, 44, 45, 46, 52, 41/59, 93, 97, 128, 198, 206–229, 290, 301, 302, 346, 347, 392, 311

[56] References Cited

UNITED STATES PATENTS

| | | | |
|---|---|---|---|
| 3,780,776 | 12/1973 | Eklund | 141/207 |
| 3,811,486 | 5/1974 | Wood | 141/208 |

*Primary Examiner*—Richard E. Aegerter
*Assistant Examiner*—Frederick R. Schmidt
*Attorney, Agent, or Firm*—J. Edward Hess; Donald R. Johnson

[57] ABSTRACT

A dispensing nozzle assembly having a system for receiving the vapors displaced from a motor vehicle gasoline tank when it is being filled, an interlock system for preventing the dispensing of gasoline until the vapor receiving bellows is in contact with the fillpipe of the vehicle gasoline tank, and an attitude control valve system to prevent vapors from the underground storage tanks from being displaced back into the atmosphere through the vapor receiving system. The interlock system includes a valve connected in the vent line running from the end of the discharge spout to the automatic shut-off system in the nozzle housing, said valve being interconnected with the vapor receiving system so that it is closed when the vapor receiving system is not in contact with a fillpipe, causing the automatic shut-off system to prevent dispensing of gasoline.

3 Claims, 9 Drawing Figures

INTERLOCK SYSTEM FOR A GASOLINE DISPENSING NOZZLE WITH A VAPOR RECEIVING SYSTEM

CROSS REFERENCES TO RELATED APPLICATIONS

This application is related to copending Applications by William B. Hansel entitled "Gasoline Dispensing Nozzle with Vapor Receiving System" and "Attitude Valve For A Gasoline Dispensing Nozzle With A Vapor Receiving System", filed of even date herewith.

BACKGROUND OF THE INVENTION

This invention relates to gasoline dispensing nozzles for dispensing gasoline into vehicle fuel tanks, and more specifically to an interlock system to prevent dispensing of gasoline until the vapor receiving system is in contact with the fillpipe for those nozzle assemblies which have a system for receiving the vapors displaced from a vehicle gasoline tank.

Current environmental regulations will require in some areas that gasoline vapors displaced from a vehicle fuel tank while being filled are to be recovered in order to prevent their escape into the atmosphere. Many of the nozzle assemblies designed to meet this requirement have a system for receiving the vapors displaced from the fuel tank and storing them in the underground hydrocarbon storage tanks.

To operate effectively, such a system should have several qualifications. First, the nozzle should fit substantially all the gasoline tank fillpipes for the vehicles currently in use and have a vapor receiving apparatus which forms a tight seal against the fillpipe so as to minimize the escape of hydrocarbons into the atmosphere. A second requirement is that the line from the vapor collecting apparaus to the underground storage tanks must have some type of control system to prevent the vapors in the underground tanks from being displaced into the atmosphere through the vapor receiving apparatus on the nozzle when the underground tanks are filled. A third requirement is that an interlock system be provided which prevents the gasoline nozzle from operating until the seal against the fillpipe is made. Compliance with these requirements preferbly should be accomplished by a design which requires minimum assistance by the service station operator, and permits manual overriding of the interlock system for use on an unusual fillpipe design which does not permit full insertion of the dispensing nozzle. Also, the entire nozzle design should be simple to operate, light enough for use in self-service stations, and not require excessive force to make the seal to the fillpipe.

One common method for providing an interlock system is to use a valve located in the discharge spout and connected to the vent line which is part of the automatic shut-off system. Then the vapor receiving system is designed to close the valve when the nozzle is not being used so that the automatic shut-off system prevents gasoline from being dispensed through the nozzle. A valve which will operate in this fashion should be small enough so that it will not appreciably affect the flow of gasoline through the discharge spout. Also, the valve design should have a sealing arrangement which not only is reliable but must permit actuation of the valve by a small amount of force so that the use of stiff springs or complicated actuation systems is not required.

SUMMARY OF THE INVENTION

In accordance with a preferred embodiment, an interlock system is provided which disables the dispensing nozzle until the vapor receiving system makes contact with the fillpipe of the vehicle gasoline tank. The interlock system includes an interlock valve located in the nozzle discharge spout which interrupts the vent line leading from the discharge end of the spout to to automatic shut-off system inside the nozzle housing. The interlock valve is biased in the open position and interconnected to the vapor receiving system through an actuating system which closes the valve when the vapor receiving system is not compressed, signifying no contact to the fillpipe has been made. A diaphragm is used to bias the valve in the open position and serves as a valve seal.

A better understanding of the invention and its advantages can be seen in the following description of the figures and preferred embodiments.

DESCRIPTION OF THE FIGURES AND THE PREFERRED EMBODIMENTS

The vapor receiving system described herein can be used on many of the nozzles that are commercially available today. However, an ideal nozzle which is lightweight and particularly adaptable to such a vapor receiving system is that shown in U.S. Pat. No. 3,734,339, by Young and is used herein in a modified form for illustrative purposes.

Figure 1:
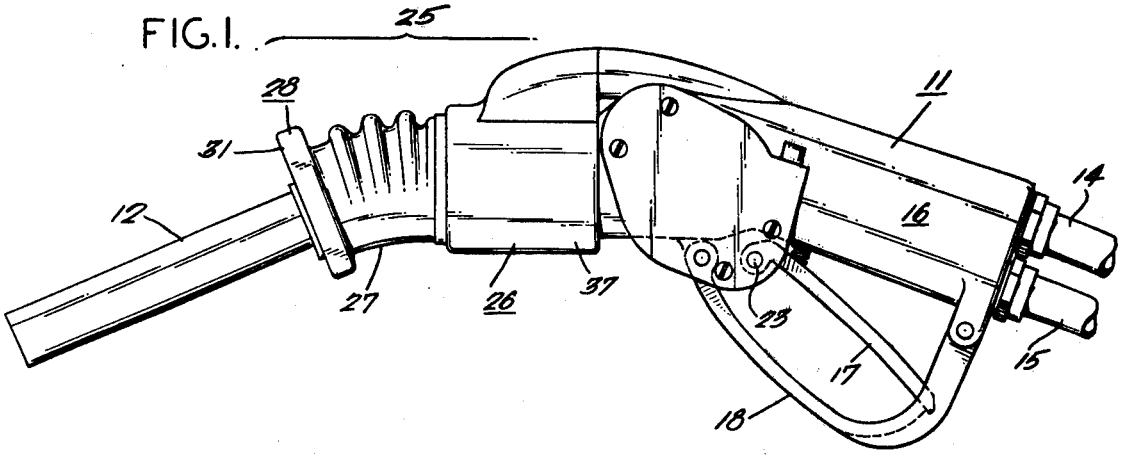
FIG. 1 is an elevational view of the dispensing nozzle according to this invention illustrating the external appearance of the nozzle assembly.
Figures 2, 9:
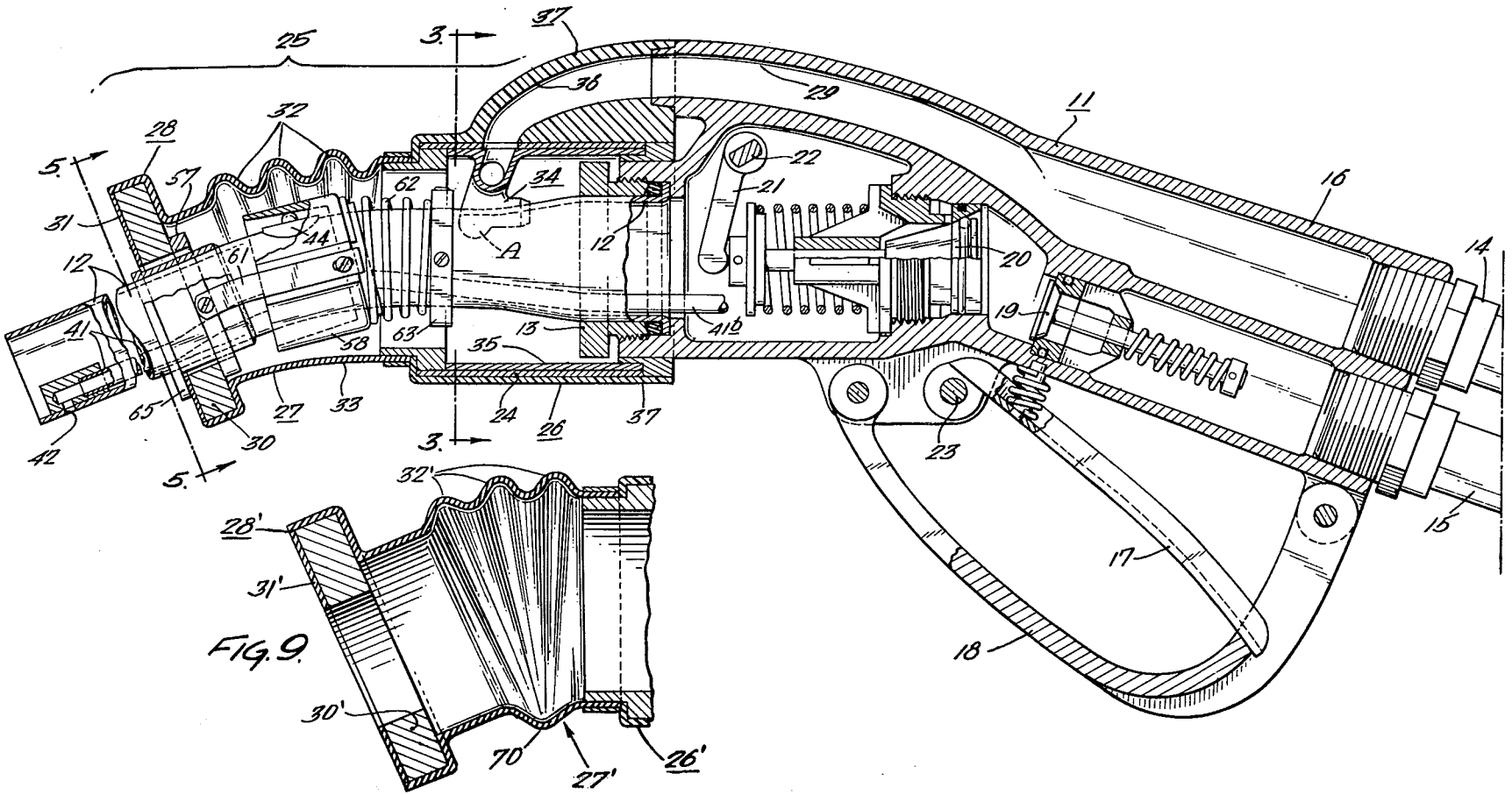
FIG. 2 is an enlarged view of the nozzle assembly of FIG. 1 shown in section.
FIG. 9 is an elevational view illustrating an alternative embodiment of the bellows.

Referring to FIGS. 1 and 2, the nozzle assembly has a housing 11 with a discharge spout 12 connected thereto by retaining nut 13. Vapor return hose 14 and the gasoline hose 15 connect to handle portion 16 of housing 11. Operation of the nozzle is accomplished by squeezing lever 17 against handle 16. Guard 18 acts to protect actuating lever 17 as well as to provide a support for holding the nozzle when it is inserted into the pump housing for storage when not in use.

The components inside the nozzle include spring-loaded check valve 19, which serves as an anti-drain valve, and main poppet valve 20 for controlling the flow of gasoline through the nozzle. Rotation of operating arm 21 on shaft 22 toward main poppet valve 20 causes it to open. Shaft 22 is connected to pivot shaft 23 of lever 17 through an automatic shut-off mechanism (not shown) which prevents gasoline from being dispensed when the liquid level in the container reaches the end of spout 12. The shut-off mechanism can be a pressure responsive diaphragm system, the principles of which are well known. A more detailed explanation of the operation of this system is contained in the above mentioned Young patent.

The vapor receiving system includes a vapor receiving chamber which has an improved design over that disclosed in U.S. Pat. No. Re. 28,294, by Hansel. The vapor receiving chamber described herein is generally denoted by the number 25 and comprises three general sections, non-flexible housing 26, flexible bellows 27, and magnetic seal section 28. A vapor return passageway 29 extends from non-flexible housing 26, through nozzle housing 11 where it is connected to vapor return line 14.

The sectional view of the nozzle assembly with the vapor receiving system shown in FIG. 2 illustrates in detail its various components. Magnetic seal 28 includes a magnetic disc 30 which has an opening large enough to permit spout 12 to pass through as well as to permit the vapors from a vehicle fuel tank to pass around spout 12 and through the opening. A soft rubber coating 31 covers the outside lateral face of magnetic disc 30, which contacts the fillpipe, so that a tight seal with the fillpipe is obtained.

Bellows 27 is designed to have sufficient stiffness for urging magnetic seal 28 against the fillpipe, but to be flexible enough to permit magnetic seal 28 to bend enough so that the proper angle for a tight seal on any particular fillpipe can be obtained. This balance between flexibility and stiffness is obtained in part by having a convoluted section 32 on the upper portion and a straight section 33 on the lower portion of bellows 27. Straight section 33 of bellows 27 permits the vapors which might be collected or condensed within the bellows to drain into the fillpipe through the opening in magnetic disc 30. An additional advantage to this bellows design is that the number of convolutions in the bellows can be minimized so that the surface area of the bellows subject to puncturing is also minimized.

The non-flexible housing 26 includes a rigid, cylindrical frame 24 which can be mounted directly on nozzle housing 11 without interferring with the normal installation of spout 12. Mounting of bellows 27 on the end of frame 24 can be accomplished by any suitable sealing method, such as by a snap ring, which is illustrated in FIG. 2. The use of a non-flexible housing also helps to reduce the length of bellows required so that the surface area of the bellows subject to puncturing is minimized.

An alternate embodiment of the bellows is illustrated in FIG. 9. In this embodiment, the convolutions in the convoluted section 32' on the upper portion of bellows 27', extend down to the lower portion of bellows 27' to merge into one convolution 70. This configuration permits the lower portion of bellows 27' to fold when the lower portion of magnetic seal 28' is pushed toward the bellows, thereby affording greater flexibility to magnetic seal 28' while still permitting most of the liquid gasoline trapped inside the vapor receiving chamber to flow back into the fillpipe.

Inside frame 24 of housing 26 is an attitude valve, 34, (see FIG. 2) formed as part of inner sleeve 35, which is in fluid communication with the top of the underground storage tanks (not shown) through vapor return hose 14, vapor return passageway 29 in nozzle housing 11, and outlet passageway 36 of outer sleeve 37. Attitude valve 34 is used for preventing the vapors in the underground storage tanks from being displaced back into the atmosphere through vapor receiving chamber 25 when the nozzle is not in use and stored in an upright position on the pump. Valve 34 can be constructed as part of inner sleeve 35 so that it can be easily inserted inside frame 24 of housing 26. Inner sleeve 35 also permits the formation of an effective seal and provides the necessary supporting structure for the valve elements.

Figure 3:
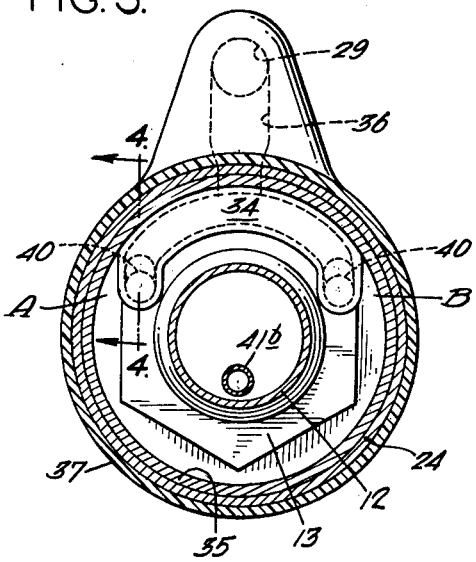
FIG. 3 is an enlarged transverse section along the line 3—3 in FIG. 2.
Figure 4:
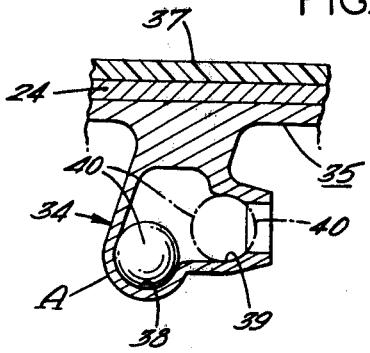
FIG. 4 is an enlarged transverse section along the line 4—4 in FIG. 3.

Valve 34 is illustrated in more detail in FIGS. 3 and 4. The lower section of valve 34 includes two identical valve compartments, A and B, which are located on either side of spout 12. Valve compartment A will now be described in more detail. Compartment A has two elongated chambers 38 and 39, with the center line of each chamber being slightly more than 90° apart or approximately 100°, preferably. Chamber 38 has an inside diameter of sufficient size to permit ball 40 to rest inside it. Chamber 39 is open to the inside of non-flexible housing 26 and has a valve seat formed by having a larger diameter section which is the same as the diameter of chamber 38 and a smaller diameter section which is smaller than the diameter of ball 40. Preferably, the bottom of chamber 39 intersects chamber 38 at a point which is approximately level with the center of ball 40 when it rests in the bottom of chamber 38, so that ball 40 when it rests in the bottom of chamber 38, so that ball 40 immediately falls into chamber 39 when the valve is slanted upwards. When filling a tank, the vapors which are displaced into bellows 27 flow through chamber 39 of both valve compartments A and B, and exit vapor receiving chamber 25 through a common outlet port in the top of frame 24 of housing 26, vapor return outlet passage 36 and passageway 29. It can be seen that when the nozzle is in a horizontal position for dispensing gasoline into a vehicle, as shown in FIG. 4, ball 40 will rest in the bottom of chamber 38, thereby permitting vapor to flow through both compartments of valve 34. When the nozzle is inserted into the pump for storage, ball 40 then rolls into chamber 39 and forms a seal against the valve seat formed in chamber 39. Any pressure developed in the underground storage tanks acts to force ball 40 against the valve seat to form a better seal. Valve 34 can also have a restriction in chamber 38 above the connection with chamber 39 so that ball 40 will not roll past chamber 39 and fail to fall into it. A peg secured in chamber 38 or a reduction in the size of the outlet can provide this feature.

Control valve 34 can be constructed in several ways. One method is to machine the chambers out of a block of metal or plastic. However, it is preferable to form the chambers out of a vinyl material as part of a sleeve structure, since the valve would be lighter and smaller, the cost of materials and labor would probably be cheaper, and ease of assembly greatly enhanced.

Most conventional gasoline dispensing nozzles use a balanced diaphragm shut-off system which acts in response to a pressure differential produced when the fillpipe in the vehicle gasoline tank becomes filled with gasoline. Such a system is also included in the nozzle of the above mentioned Young patent. As illustrated in the drawings, vent tube 41 travels through discharge spout 12 from opening 42 to one of the chambers on one side of the shut-off diaphragm (not shown). This side of the chamber is also connected to a venturi arrangement so that the flow of gasoline creates a vacuum on this side of the diaphragm which is relieved by having opening 42 in spout 12 open. However, when opening 42 is closed, such as by gasoline reaching the end of the spout, the vacuum from the venturi causes the shut-off diaphragm to disengage lever 17 so that gasoline can no longer be dispensed.

When using a vapor receiving system on the nozzle, higher pressures can develop within the fillpipe which slow down the response of the diaphragm mechanism because it takes longer to produce the necessary vacuum. This problem is recognized and a remedy therefore is disclosed and claimed in copending application by Hansel, entitled "Automatic Dispensing Nozzle Adapted for Vapor Recovery," Ser. No. 468,841, filed May 10, 1974. According to this disclosure, the second chamber on the other side of the shut-off diaphragm from the venturi is connected to the vapor receiving chamber for use as a reference pressure instead of using atmospheric pressure. This arrangement allows the two pressures on either side of the diaphragm to be about the same while filling so that a lesser amount of vacuum is needed to cause the shut-off diaphragm system to disengage lever 17.

Such an arrangement can be included in the nozzle assembly disclosed and claimed herein by having a passageway connecting the vapor return passageway 29 inside nozzle housing 11 to the chamber on the second side of the shut-off diaphragm.

One of the requirements of the new regulations may that the nozzle must not be able to dispense gasoline until the seal against the fillpipe is made by vapor receiving chamber 25. An interlock valve system to perform this function is included in the nozzle assembly design. While various valve designs can be used to perform this function, the design disclosed herein is particularly adapted for use in such an environment. Preferably, the interlock valve should be connected to vent line 41 and installed inside the spout so that its actuating mechanism can remain simple in design and can be replaced without completely disassemblying the nozzle. The interlock valve, 44, illustrated in FIG. 6 has a valve housing 45 with an inlet port 46 connected to section 41*a* of vent line 41, which terminates at port 42, and an outlet port 47 connected to section 41*b* of vent line 41 which terminates at a diaphragm chamber in the nozzle housing for the automatic shut-off system. The internal sructure of valve 44 has an inlet passageway 48 which leads from inlet port 46 to valve chamber 49 and an outlet passageway 50 leading from valve chamber 49 to outlet port 47. A valve seat 51 is formed at the entrance of outlet passageway 50 from chamber 49. A flexible biasing diaphragm 52 is stretched across the top of valve housing 45 to cover chamber 49. A valve stem 53 is mounted to diaphragm 52 so that the valve head 54 is suspended above valve seat 51 and the top portion, 55, of stem 53 is secured to the top of diaphragm 52. Biasing diaphragm 52 serves to bias the valve in a normally open position as well as to seal valve housing 45. Closing of the valve is accomplished by applying pressure to top portion 55 of stem 53. The design of interlock valve 44 permits it to be constructed so that it is small enough to fit inside spout 12 and will not appreciably affect the flow rate of the nozzle.

Figure 8:
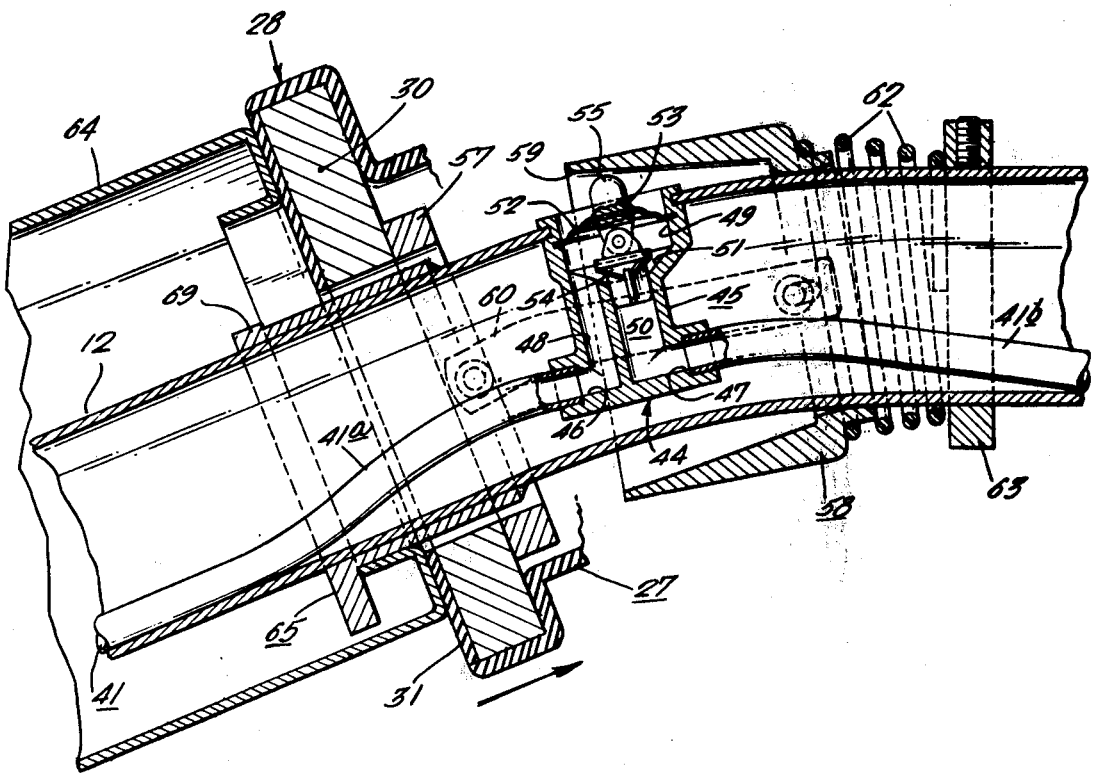
FIG. 8 is a view similar to FIG. 6 illustrating the interlock valve in its open position with the magnetic disc in contact with a fillpipe.
Figure 7:
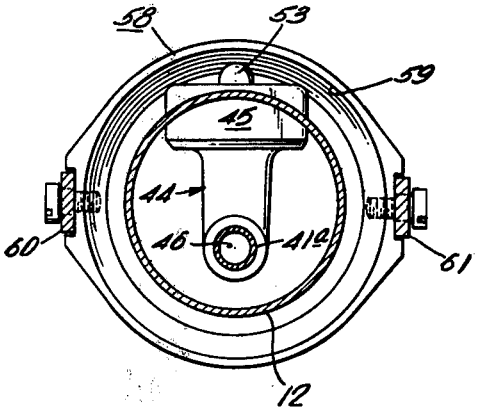
FIG. 7 is a transverse section along the line 7—7 in FIG. 6
Figure 6:
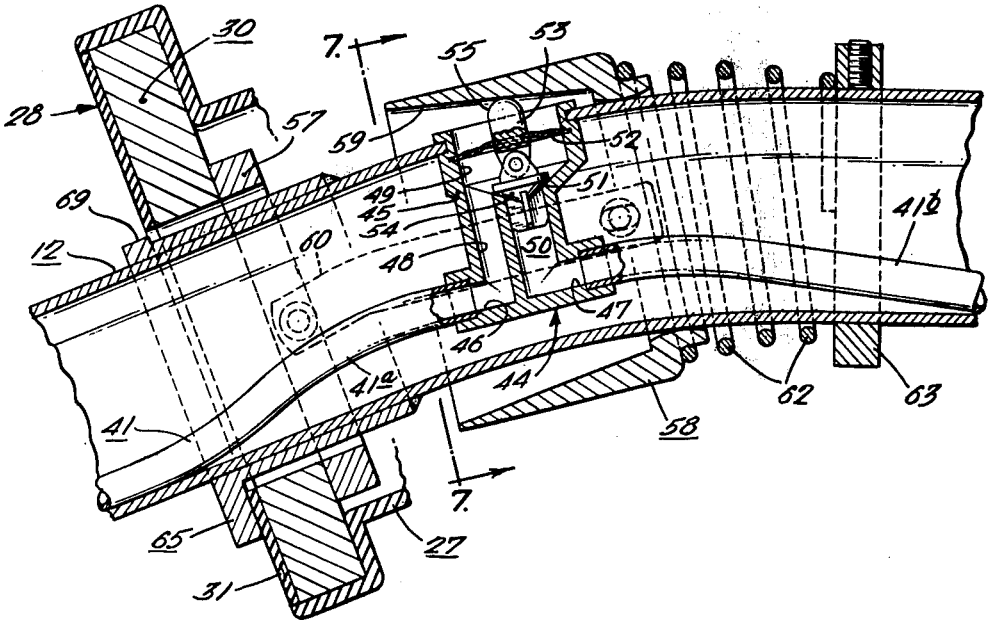
FIG. 6 is an enlarged fragmentary section through the discharge spout illustrating the interlock valve in its closed position.

An interlock actuating system is provided to close interlock valve 44 when bellows 27 is in its normal position and to permit valve 44 to assume its normally open position when bellows 27 is compressed (see FIGS. 6, 7 and 8). The actuating system includes a slip ring 57 located next to the inside of magnetic disc 39, a slidable collar 58 having a tapered inside surface 59 and two actuating arms, 60 and 61, rotatably connected at one end to slip ring 57 and at the other end to collar 58. A spring 62 and retaining ring 63 bias the actuating system in the closed position, with slip ring 57 being urged against magnetic disc 30. The length of actuating arms 60 and 61 are designed so that collar 58 is located over interlock valve 44 when bellows 27 is fully extended, causing the tapered edge 59 of collar 58 to press against the top portion 55 of valve stem 53, forcing valve head 54 against valve seat 51.

With this interlock system, when contact is made by magnetic seal 28 against the fillpipe (64) of a vehicle, magnetic disc 30 will be attracted toward the fillpipe and slip ring 57 and collar 58 will be displaced a slight amount by pushing discharge spout 12 further into the fillpipe, thereby opening interlock valve 44 in vent tube 41. However, if magnetic seal 28 is not displaced toward the nozzle housing 11, valve 44 will remain closed and a vacuum will be created by the venturi in the nozzle housing when lever 17 is squeezed towards handle 16, causing the cut-off diaphragm to disengage lever 17 and prevent gasoline from being dispensed. To override the interlock valve, compression of bellows 27 that is required. This fact encourages the operator to properly insert the nozzle into the fillpipe so that he does not need to hold the nozzle, but also allows use of the nozzle when it does not fit the particular fuel tank.

Figure 5:
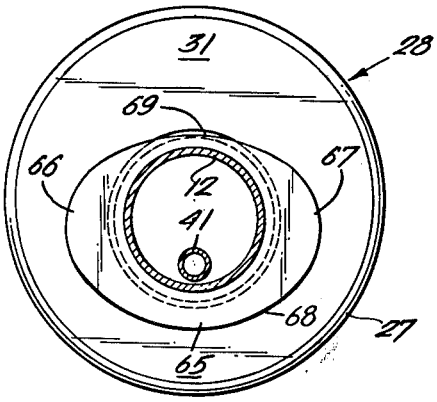
FIG. 5 is an enlarged transverse section along the line 5—5 in FIG. 2.

A latching collar 65 (see FIGS. 2 and 5) is mounted on spout 12 at the location of magnetic seal 28 when bellows 27 is in its normal, relaxed position. The function of collar 65 is to connect spout 12 to the fillpipe of a vehicle, similar to that shown in FIG. 8, so that the nozzle will remain in position without the aid of its operator. An additional function of collar 65 is to prevent bellows 27 from being over extended when the nozzle is removed from the fillpipe, due to the magnetic attraction between the fillpipe and magnetic seal 28. Therefore, collar 65 is designed to have wide side extensions, 66 and 67, for contacting the surface of magnetic seal 28 to prevent over extension of bellows 27, a smaller bottom extension 68 to catch the inside of the fillpipe, and a narrow top portion 69 to permit sufficient flow of vapor around the collar and through the opening in magnetic disc 30, as illustrated in FIGS. 5 and 8.

When the nozzle is not in use it is normally placed inside a slot (not shown) on the gasoline pump which means that the nozzle will be sitting in a vertical position. In this position ball 40 of attitude valve 35 will be in a closed position so that no vapors from the underground storage tanks will be able to flow through vapor return line 14, vapor return passageway 29, and vapor receiving chamber 25 into the atmosphere. Once the nozzle is removed and held in a horizontal position, ball 40 rolls away from the valve set and into chamber 38. This action permits vapor to flow through valve 35. When discharge spout 12 of the nozzle is inserted into the vehicle fuel tank, the magnetic attraction of magnetic seal 28 brings the entire section in contact with the fillpipe opening to make a tight seal. Depending on the angle of the particular vehicle fillpipe, the top portion of bellows 27 will either expand or contract to help make a tight seal at the fillpipe. Upon insertion of the spout a few more fractions of an inch, latching collar 65 will lodge on the backside of the fillpipe opening and magnetic seal 28 will be displaced toward nozzle housing 11 a sufficient distance to cause interlock valve 44 to open so that gasoline can be dispensed into the fillpipe. When the gasoline tank becomes filled, gasoline will reach the end of spout 12 and cover opening 42 so that a vacuum is created on one side of the shut-off diaphragm mechanism, which disengages lever 17 to prevent the dispensing of more gasoline. When the spout 12 is withdrawn from the vehicle fillpipe, magnetic seal 28 remains against the fillpipe until side extensions 66 and 67 of latching collar 65 contact magnetic seal 28 and pull it away from the fillpipe. Once the nozzle is returned into its storage slot on the pump, attitude valve 34 moves into its closed position to again prevent the flow of vapor from the underground storage tank into the atmosphere.

While particular embodiments of this invention have been shown and described, it is obvious that changes and modifications can be made without departing from the true spirit and scope of the invention. It is the intention of the appended claims to cover all such changes and modifications.

The invention claimed is:

1. In a fluid dispensing nozzle having, a. a nozzle housing;

b. a discharge spout connected to the nozzle housing;

c. a main nozzle valve, located in the nozzle housing;

d. menas for controlling the position of the main nozzle valve to regulate the dispensing of fluid through the nozzle;

e. a pressure chamber located in the nozzle housing;

f. a vent line connected between the pressure chamber and the discharge end of the discharge spout;

g. means for creating fluid flow through the vent line and out through the pressure chamber in response to the flow of fluid through the nozzle;

h. means responsive to the pressure in the pressure chamber falling below a predetermined amount, for placing the nozzle valve controlling means in a disabling position so that dispensing of fluid is prevented; and i. a vapor receiving system having a bellows section and a face seal connected thereto for contacting the fillpipe inlet;

an improvement comprising an interlock system for preventing the dispensing of fluid through the nozzle until the discharge spout of the nozzle is properly inserted in the fillpipe of the tank to be filled, said interlock system comprising:

j. an interlock valve mounted in the discharge spout and connected in the vent line so that fluid flow through the vent line is permitted when said valve is in its open position, and fluid flow through the vent line is prevented when said valve is in its closed position, said valve comprising, i. a valve housing with a chamber therein, the chamber having a first side open to the outside of the housing, ii. a valve seat mounted in said valve housing and in fluid communication with the chamber, iii. first and second valve ports connected to the vent line, iv. means for providing fluid communication between the valve seat and the first and second valve ports, v. a flexible diaphragm sealably mounted across the open side of the chamber in the valve housing, vi. a valve head mounted on the inside surface of the diaphragm so that movement of the diaphragm toward the valve seat a predetermined distance causes the valve head to contact the valve seat, thereby causing the valve to obtain a closed position, vii. means for biasing the diaphragm and valve head away from the valve seat with the valve in its open position, and viii. a valve stem mounted on the outside surface of the diaphragm; and k. a movable member mounted on the discharge spout at or nearly at the location of the interlock valve, said movable member having a contact surface such that when the member is in a first position the contact surface is against the valve stem, causing the interlock valve to obtain a closed position to prevent dispensing of liquid, and such that when the member obtains a second position, the contact surface no longer is against the valve stem, thereby permitting the interlock valve to obtain an open position, to enable dispensing of liquid;

l. means for biasing the movable member to its first position; and m. means, responsive to the face seal being displaced a predetermined distance, for contacting the movable member so that the movable member moves from its first position to its second position to open the interlock valve when the face seal has been displaced the predetermined distance.

2. The nozzle recited in claim 1, wherein the movable member is a slidable collar surrounding the discharge spout at or nearly at the location of the interlock valve, said collar having an inside tapered surface such that when the collar is in its first position the tapered surface contacts the valve stem, causing the interlock valve to obtain a closed position to prevent dispensing of liquid, and such that when the collar obtains its second position, the tapered surface no longer contacts the valve stem, thereby permitting the interlock valve to obtain an open position, to enable liquid to be dispensed.

3. The nozzle recited in claim 2, wherein the diaphragm is designed so that it biases the valve stem in its open position, away from the valve seat.

* * * * *